US011790767B2

(12) United States Patent
Cai et al.

(10) Patent No.: US 11,790,767 B2
(45) Date of Patent: Oct. 17, 2023

(54) METHOD, APPARATUS, DEVICE AND STORAGE MEDIUM FOR PRE-WARNING OF AIRCRAFT FLIGHT THREAT EVOLUTION

(71) Applicant: BEIHANG UNIVERSITY, Beijing (CN)

(72) Inventors: Kaiquan Cai, Beijing (CN); Yanbo Zhu, Beijing (CN); Jiatong Chen, Beijing (CN); Lanchenhui Yu, Beijing (CN)

(73) Assignee: BEIHANG UNIVERSITY, Beijing (CN)

( * ) Notice: Subject to any disclaimer, the term of this patent is extended or adjusted under 35 U.S.C. 154(b) by 197 days.

(21) Appl. No.: 17/485,271

(22) Filed: Sep. 24, 2021

(65) Prior Publication Data

US 2022/0148436 A1 May 12, 2022

(30) Foreign Application Priority Data

Nov. 12, 2020 (CN) ..... 202011264428.9

(51) Int. Cl.
*G08B 31/00* (2006.01)
*G08G 5/00* (2006.01)

(52) U.S. Cl.
CPC ..... *G08B 31/00* (2013.01); *G08G 5/0013* (2013.01); *G08G 5/0026* (2013.01); *G08G 5/0052* (2013.01)

(58) Field of Classification Search
CPC .... G08B 31/00; G08G 5/0013; G08G 5/0026; G08G 5/0052; G08G 5/0091
See application file for complete search history.

(56) References Cited

U.S. PATENT DOCUMENTS 8,600,587 B1 * 12/2013 Seah ..... G01C 23/00 701/14
2018/0018886 A1 1/2018 McCullen
(Continued)

FOREIGN PATENT DOCUMENTS

CN 106508038 B 7/2014
CN 105956790 A 9/2016
(Continued)

OTHER PUBLICATIONS

Notice of Allowance of the priority CN application No. 202011264428.9.
(Continued)

*Primary Examiner* — Andrew W Bee
(74) *Attorney, Agent, or Firm* — J.C. PATENTS

(57) ABSTRACT

Embodiments of the present disclosure provide a method, an apparatus, a device and a storage medium for pre-warning of aircraft flight threat evolution. The method includes: inputting historical threat situation data to an evolution model that has been trained to convergence to output each evolution mode corresponding to the historical threat situation data and a probability corresponding to the evolution mode; obtaining evolution trend data corresponding to the historical threat situation data according to the evolution mode and the probability; assigning a detection task to other aircraft within a preset range of a target aircraft according to a crowdsourcing strategy, and acquiring current actual flight threat information detected by the other aircraft according to the detection task; sending pre-warning information to a pre-warning device if the flight threat meets a pre-warning condition.

13 Claims, 6 Drawing Sheets

(56) References Cited

U.S. PATENT DOCUMENTS

| | | | | |
|---|---|---|---|---|
| 2019/0066519 | A1* | 2/2019 | Kneuper | G06N 20/00 |
| 2019/0304314 | A1* | 10/2019 | Hochwarth | G08G 5/0091 |

FOREIGN PATENT DOCUMENTS

| | | | | | |
|---|---|---|---|---|---|
| CN | 106803362 | A | | 6/2017 | |
| CN | 108830032 | A | | 11/2018 | |
| CN | 109903590 | A | | 6/2019 | |
| CN | 109977546 | A | | 7/2019 | |
| CN | 110379210 | A | | 10/2019 | |
| CN | 111144290 | A | | 5/2020 | |
| CN | 111819610 | A | | 10/2020 | |
| KR | 20220001704 | A | * | 1/2022 | G08B 21/182 |

OTHER PUBLICATIONS

NPL: "Flight Delay Prediction Method Based on Deep Learning", Command Information System and Technology, vol. 11, No. 5, Oct. 2020.

* cited by examiner

METHOD, APPARATUS, DEVICE AND STORAGE MEDIUM FOR PRE-WARNING OF AIRCRAFT FLIGHT THREAT EVOLUTION

CROSS-REFERENCE TO RELATED APPLICATIONS

This application claims priority to Chinese Patent Application No. 202011264428.9, filed on Nov. 12, 2020, which is hereby incorporated by reference in its entirety.

TECHNICAL FIELD

Embodiments of the present disclosure relate to the field of aviation safety technology, and in particular, to a method, an apparatus, a device and a storage medium for pre-warning of aircraft flight threat evolution.

BACKGROUND

Safe operation of air traffic is the eternal focus and primary guarantee in the field of civil aviation. In recent years, the civil aviation industry has developed rapidly and the number of flights has increased significantly. The current air traffic control system has gradually been unable to meet the requirements for safe and efficient operation; on the other hand, a premise of ensuring the safe operation of aircraft is to accurately predict the evolution of air traffic safety situation, so as to achieve pre-warning and avoidance of dangerous scenes.

However, the air traffic safety situation is directly affected by the flight threat situation. Those threats mainly include dangerous weather, such as thunderstorms, turbulence, etc., as well as flight conflict, such as collisions of controlled aircraft and intrusion of uncontrolled aircraft into controlled airspace. The characteristics of the flight threat situation are composed of impact scope and impact intensity. The impact scope determines the affected area of the threat situation, and the impact intensity determines the degree of danger of the threat situation at various points in the area. Therefore, flight threats pose a great challenge to the perception and prediction of air traffic safety situation.

At present, due to the characteristics of high dynamics and strong impact of flight threats, there is a lack of pre-warning methods for threats to aircraft operation.

SUMMARY

The present disclosure provides a method, an apparatus, a device and a storage medium for pre-warning of aircraft flight threat evolution, which is used to solve the current lack of pre-warning methods for threats to aircraft operation.

In a first aspect, an embodiment of the present disclosure provides a method for pre-warning of aircraft flight threat evolution, which is applied to an electronic device and includes:

acquiring historical threat situation data within a preset area range of a target flight route;

inputting the historical threat situation data to an evolution model that has been trained to convergence, to output each evolution mode corresponding to the historical threat situation data and a probability corresponding to the evolution mode;

obtaining evolution trend data corresponding to the historical threat situation data according to the evolution mode and the probability;

assigning a detection task to other aircraft within a preset range of a target aircraft according to a crowdsourcing strategy, and acquiring current actual flight threat information detected by the other aircraft according to the detection task;

determining enhanced evolution data according to the current actual flight threat information and the evolution trend data;

acquiring current flight route information of the target aircraft, and predicting a flight threat to the target aircraft in a preset future time period according to the current flight route information and the enhanced evolution data; and sending pre-warning information to a pre-warning device if the flight threat meets a pre-warning condition.

Further, in the above method, the acquiring the historical threat situation data within the preset area range of the target flight route includes:

determining multiple sampling points within the preset area range of the target flight route;

acquiring at least one type of historical threat situation data corresponding to each sampling point, where each type of historical threat situation data of each sampling point includes historical threat position data and historical threat intensity data;

generating a corresponding relational sequence between each piece of historical threat situation data and time for each sampling point according to flight time information of the target flight route;

the inputting the historical threat situation data into the evolution model that has been trained to convergence, to output each evolution mode corresponding to the historical threat situation data and the probability corresponding to the evolution mode includes:

inputting the corresponding relational sequence between each piece of historical threat situation data and time for each sampling point to the evolution model that has been trained to convergence, to output each evolution mode corresponding to each relational sequence of each sampling point upon each type of historical threat situation data and the probability corresponding to the evolution mode.

Further, in the above method, the obtaining the evolution trend data corresponding to the historical threat situation data according to the evolution mode and the probability includes:

performing a weighted summation operation on each evolution mode corresponding to each relational sequence and the probability corresponding to the evolution mode according to the probability to obtain the evolution trend data corresponding to each relational sequence;

merging the evolution trend data corresponding to each relational sequence of each sampling point upon each type of historical threat situation data to obtain the evolution trend data corresponding to each sampling point upon each type of historical threat situation data;

merging the evolution trend data corresponding to all the sampling points upon each type of historical threat situation data to obtain the evolution trend data corresponding to each type of historical threat situation data.

Further, in the above method, the current flight route information includes current flight route position information and current flight route time information; the enhanced evolution data includes threat range evolution data and threat intensity evolution data;

the predicting the flight threat to the target aircraft in the preset future time period according to the current flight route information and the enhanced evolution data includes:

determining whether corresponding current threat range evolution data in the enhanced evolution data matches the current flight route position information according to the current flight route position information and the current flight route time information;

if matching the current flight route position information is determined, determining the threat range evolution data and the threat intensity evolution data of the target aircraft in the preset future time period according to the enhanced evolution data;

determining the flight threat according to the threat range evolution data and the threat intensity evolution data in the preset future time period.

Further, before the inputting the historical threat situation data to the evolution model that has been trained to convergence, the method as described above further includes:

acquiring a training sample, where the training sample includes: the corresponding relational sequence between each piece of historical threat situation data and time and a corresponding actual evolution mode and a probability corresponding to the actual evolution mode;

inputting the training sample into a preset evolution model to train the preset evolution model;

using a preset error formula to determine whether the preset evolution model meets a convergence condition;

if the preset evolution model meets the convergence condition, determining the preset evolution model that meets the convergence condition as the evolution model that has been trained to convergence.

Further, in the above method, the determining the enhanced evolution data according to the current actual flight threat information and the evolution trend data includes:

calculating an error value between the current actual flight threat information and the evolution trend data in a corresponding area;

inputting the error value into a preset prediction model to output a prediction error value;

determining the enhanced evolution data according to the evolution trend data and the prediction error value.

In a second aspect, an embodiment of the present disclosure provides an apparatus, which is located in an electronic device and includes:

an acquiring module, configured to acquire historical threat situation data within a preset area range of a target flight route;

an evolution module, configured to input the historical threat situation data to an evolution model that has been trained to convergence, to output each evolution mode corresponding to the historical threat situation data and a probability corresponding to the evolution mode;

an evolution trend determining module, configured to obtain evolution trend data corresponding to the historical threat situation data according to the evolution mode and the probability;

a threat predicting module, configured to assign a detection task to other aircraft within a preset range of a target aircraft according to a crowdsourcing strategy, and acquire current actual flight threat information detected by the other aircraft according to the detection task; determine enhanced evolution data according to the current actual flight threat information and the evolution trend data; acquire current flight route information of the target aircraft, and predict a flight threat to the target aircraft in a preset future time period according to the current flight route information and the enhanced evolution data;

a pre-warning module, configured to send pre-warning information to a pre-warning device if the flight threat meets a pre-warning condition.

Further, in the above apparatus, the acquiring module is specifically configured to:

determine multiple sampling points within the preset area range of the target flight route; acquire at least one type of historical threat situation data corresponding to each sampling point, where each type of historical threat situation data of each sampling point includes historical threat position data and historical threat intensity data; generate a corresponding relational sequence between each piece of historical threat situation data and time for each sampling point according to flight time information of the target flight route;

the evolution module is specifically configured to:

input the corresponding relational sequence between each piece of historical threat situation data and time for each sampling point to the evolution model that has been trained to convergence, to output each evolution mode corresponding to each relational sequence of each sampling point upon each type of historical threat situation data and the probability corresponding to the evolution mode.

Further, in the above apparatus, the evolution trend determining module is specifically configured to:

perform a weighted summation operation on each evolution mode corresponding to each relational sequence and the probability corresponding to the evolution mode according to the probability to obtain the evolution trend data corresponding to each relational sequence; merge the evolution trend data corresponding to each relational sequence of each sampling point upon each type of historical threat situation data to obtain the evolution trend data corresponding to each sampling point upon each type of historical threat situation data; merge the evolution trend data corresponding to all the sampling points upon each type of historical threat situation data to obtain the evolution trend data corresponding to each type of historical threat situation data.

Further, in the above apparatus, the current flight route information includes current flight route position information and current flight route time information; the enhanced evolution data includes threat range evolution data and threat intensity evolution data;

when predicting the flight threat to the target aircraft in the preset future time period according to the current flight route information and the enhanced evolution data, the threat predicting module is specifically configured to:

determine whether corresponding current threat range evolution data in the enhanced evolution data matches the current flight route position information according to the current flight route position information and the current flight route time information; if matching the current flight route position information is determined, determine the threat range evolution data and the threat intensity evolution data of the target aircraft in the preset future time period according to the enhanced evolution data; determine the flight threat according to the threat range evolution data and the threat intensity evolution data in the preset future time period.

Further, in the above apparatus, the apparatus further includes a training module, the training module is configured to:

acquire a training sample, where the training sample includes: the corresponding relational sequence between each piece of historical threat situation data and time and a corresponding actual evolution mode and the probability corresponding to the actual evolution mode; input the training sample into a preset evolution model to train the preset evolution model; use a preset error formula to determine whether the preset evolution model meets a convergence condition; if the preset evolution model meets the convergence condition, determine the preset evolution model that meets the convergence condition as the evolution model trained to convergence.

Further, in the above apparatus, when determining the enhanced evolution data according to the current actual flight threat information and the evolution trend data, the threat predicting module is specifically configured to:

calculate an error value between the current actual flight threat information and the evolution trend data in a corresponding area; input the error value into a preset prediction model to output a prediction error value; determine the enhanced evolution data according to the evolution trend data and the prediction error value.

In a third aspect, an embodiment of the present disclosure provides a device for pre-warning of aircraft flight threat evolution, including: a memory, a processor;

the memory; the memory configured to store instructions executable by the processor;

where the processor is configured to perform the method for pre-warning of aircraft flight threat evolution according to any one of the first aspect.

The a fourth aspect, an embodiment of the present disclosure provides a computer-readable storage medium having computer-executable instructions stored thereon which, when executed by a processor, are used to implement the method for pre-warning of aircraft flight threat evolution according to any one of the first aspect.

Embodiments of the present disclosure provides a method, an apparatus, a device and a storage medium for pre-warning of aircraft flight threat evolution. The method is applied to an electronic device and includes: acquiring historical threat situation data within a preset area range of a target flight route; inputting the historical threat situation data to an evolution model that has been trained to convergence, to output each evolution mode corresponding to the historical threat situation data and a probability corresponding to the evolution mode; obtaining evolution trend data corresponding to the historical threat situation data according to the evolution mode and the probability; assigning a detection task to other aircraft within a preset range of a target aircraft according to a crowdsourcing strategy, and acquiring current actual flight threat information detected by the other aircraft according to the detection task; determining enhanced evolution data according to the current actual flight threat information and the evolution trend data; acquiring current flight route information of the target aircraft, and predicting a flight threat to the target aircraft in a preset future time period according to the current flight route information and the enhanced evolution data; sending pre-warning information to a pre-warning device if the flight threat meets a pre-warning condition. In the method for pre-warning of aircraft flight threat evolution according to the embodiments of the present disclosure, the historical threat situation data within the preset area range of the target flight route is acquired and the historical threat situation data is inputted to the evolution model that has been trained to convergence, so as to obtain subsequent evolution trend data corresponding to the historical threat situation data according to the outputted evolution mode and the probability; and the detection task is assigned to other aircraft within the preset range of the target aircraft according to the crowdsourcing strategy, so that the enhanced evolution data can be determined more accurately. Therefore, the flight threat in the preset future time period can be predicted according to the enhanced evolution data, and by considering the current flight route information of the target aircraft in combination with the enhanced evolution data, the flight threat to the target aircraft in the preset future time period can be predicted, so that when the flight threat meets the pre-warning condition, the pre-warning information is sent to the pre-warning device, thereby realizing the pre-warning of aircraft flight threat.

BRIEF DESCRIPTION OF DRAWINGS

The accompanying drawings here are incorporated into the specification and constitute a part of the specification, indicate embodiments in accordance with the present disclosure, and are used to explain the principle of the present disclosure with the specification.

Through the above drawings, the specific embodiments of the present disclosure have been shown, which will be described in detail below. These drawings and text description are not intended to limit the scope of the inventive conception in any way, but to explain the concept of the disclosure to the skilled in the art by referring to specific embodiments.

DESCRIPTION OF EMBODIMENTS

Illustrative embodiments will be described in detail here, and examples thereof are shown in the accompanying drawings. When the following description refers to the drawings, unless otherwise indicated, the same numbers in different drawings indicate the same or similar elements. The implementation manners described in the following illustrative embodiments do not represent all implementation manners consistent with the present disclosure. On the contrary, they are merely examples of devices and methods consistent with some aspects of the present disclosure as detailed in the appended claims.

The technical solutions of the present disclosure will be described in detail below with specific embodiments. The following specific embodiments may be combined with each other, and the same or similar concepts or processes may not be repeated in some embodiments. The embodiments of the present disclosure will be described below in conjunction with the accompanying drawings.

First, the terms involved in the embodiments of the present disclosure are explained:

FCM: the full name is: Fuzzy C-Means. FCM is an algorithm that determines the probability of each data point belonging to a certain cluster through stepwise iteration, so that similarity is high for a cluster of the same type and similarity is low for a cluster of a different type. The clustering algorithm can be regarded as an improvement of the traditional hard clustering algorithm.

Xie and Beni index and Fukuyama-Sugeno index: they are clustering effective indexes. The lower the indexes are, the better the clustering effect is.

Evolution: it refers to changes without a direction, which may be evolution from simple to complex, or degeneration from complex to simple.

Figure 1:
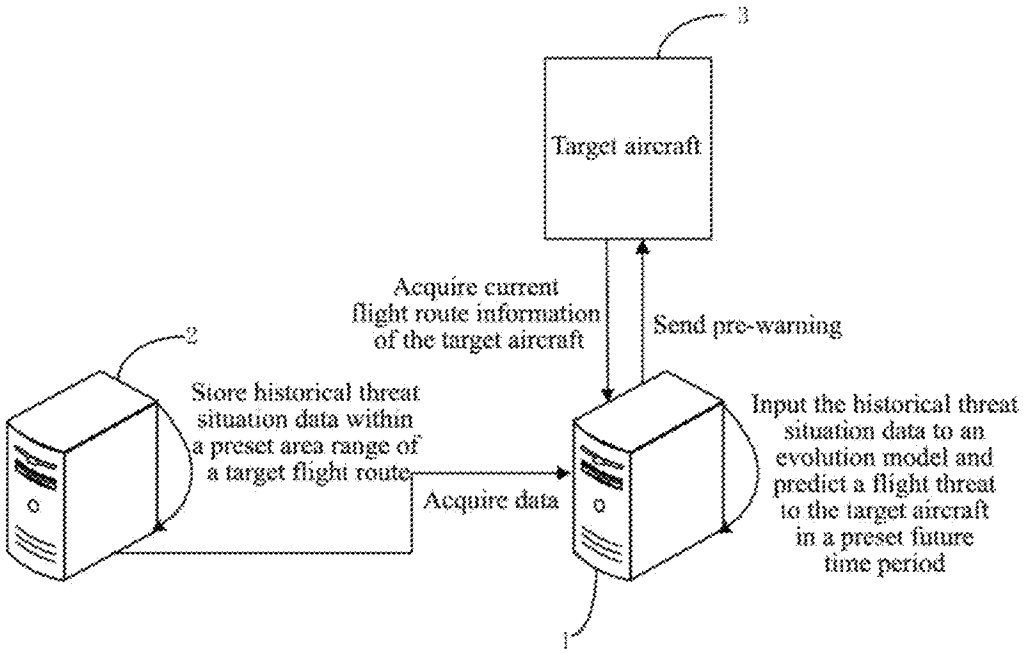
FIG. 1 is a scenario diagram which can realize a method for pre-warning of aircraft flight threat evolution according to an embodiment of the present disclosure.

The following describes an application scenario of the method for pre-warning of aircraft flight threat evolution provided by an embodiment of the present disclosure. As shown in FIG. 1, 1 is a first electronic device, 2 is a second electronic device, and 3 is a target aircraft. The network architecture of the application scenario corresponding to the method for pre-warning of aircraft flight threat evolution provided by the embodiment of the present disclosure includes: a first electronic device 1, a second electronic device 2 and a target aircraft 3. The second electronic device 2 stores historical threat situation data, especially the historical threat situation data within a preset area range of a target flight route. The first electronic device 1 acquires the historical threat situation data within the preset area range of the target flight route from the second electronic device 2. The preset area range may be 10 kilometers around the target flight route or set according to actual needs. Then the historical threat situation data is inputted into the evolution model that has been trained to converge, to output each evolution mode corresponding to the historical threat situation data and the probability corresponding to the evolution mode. With the evolution mode and the probability corresponding to the evolution mode, evolution trend data corresponding to the historical threat situation data can be calculated, and how the historical threat situation data will evolve in a future time period may be predicted according to the evolution trend data. Then, a detection task is assigned to other aircraft within the preset range of a target aircraft according to a crowdsourcing strategy, and current actual flight threat information is acquired which is detected by the other aircraft according to the detection task, so as to obtain enhanced evolution data according to the evolution trend data and the current actual flight threat information. Therefore, the current flight route information of the target aircraft obtained from the target aircraft 3 is combined with the enhanced evolution data to predict a flight threat to the target aircraft in the preset future time period. If the flight threat meets the pre-warning condition, pre-warning information is sent to a pre-warning device in the aircraft.

In the method for pre-warning of aircraft flight threat evolution according to the embodiment of the present disclosure, the historical threat situation data within the preset area range of the target flight route is acquired and the historical threat situation data is inputted to the evolution model that has been trained to convergence, so as to obtain the subsequent evolution trend data corresponding to the historical threat situation data according to the outputted evolution mode and the probability; and the detection task is assigned to other aircraft within the preset range of the target aircraft according to the crowdsourcing strategy, so that the enhanced evolution data can be determined more accurately. Therefore, the flight threat in the preset future time period can be predicted according to the enhanced evolution data, and by considering the current flight route information of the target aircraft in combination with the enhanced evolution data, the flight threat to the target aircraft in future the preset time period can be predicted, so that when the flight threat meets the pre-warning condition, the pre-warning information is sent to the pre-warning device, thereby realizing the pre-warning of the aircraft flight threat.

The embodiments of the present disclosure will be described below in conjunction with the drawings of the specification.

Figure 2:
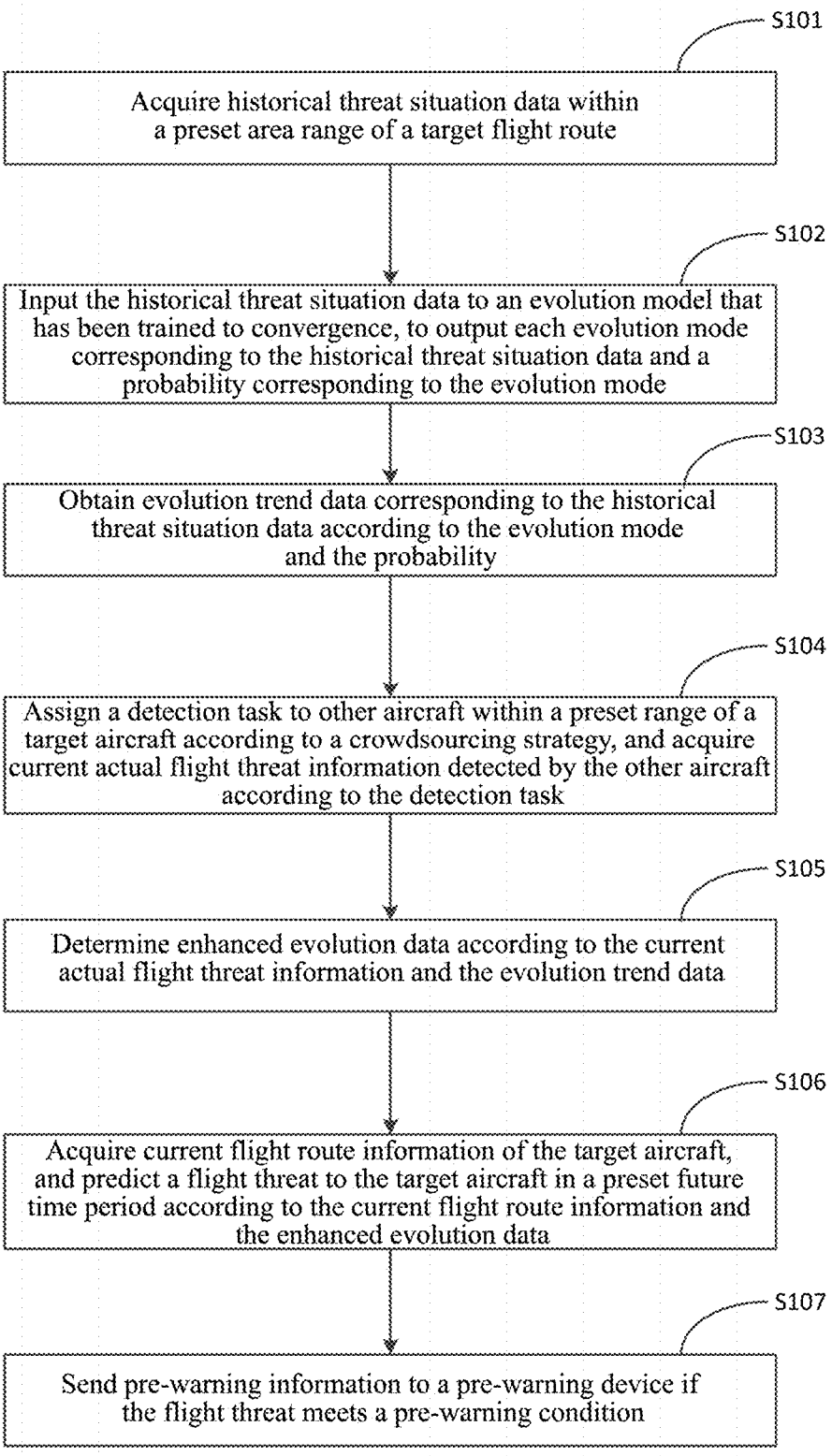
FIG. 2 is a schematic flowchart of a method for pre-warning of aircraft flight threat evolution provided by an embodiment of the present disclosure.

FIG. 2 is a schematic flowchart of a method for pre-warning of aircraft flight threat evolution provided by an embodiment of the present disclosure. As shown in FIG. 2, in the embodiment, the executive entity of the embodiment of the present disclosure is an apparatus for pre-warning of aircraft flight threat evolution, and the apparatus for pre-warning of aircraft flight threat evolution may be integrated in an electronic device. The method for pre-warning of aircraft flight threat evolution provided by the embodiment includes the following steps:

Step S101: acquire historical threat situation data within a preset area range of a target flight route.

First, in the embodiment, the target flight route is a flight route on which a target aircraft will fly. The preset area range may be a sphere area with the target aircraft as the origin and a preset length as the radius. For example, the preset length is 5 kilometers. It can be understood that the radius of the sphere may be set according to actual needs, which is not limited in the embodiment.

In the embodiment, the historical threat situation data refers to recorded historical flight threat situation data. The historical threat situation data may be collected through operation of aircraft on a corresponding flight route in the past time period, or various types of flight threat situation data may be recorded by a ground control center or a meteorological system. After completing the collection of the historical threat situation data, a storage database of the historical threat situation data may be established, and the historical threat situation data may be stored in the storage database, so that when a target aircraft needs to be provided with flight threat pre-warning, it can obtain the historical threat situation data directly from the storage database to improve the efficiency of flight threat pre-warning.

In the embodiment, there are multiple types of the historical threat situation data, such as thunderstorms, turbulence, and flight conflict threats, etc. The data change of each type of historical threat situation data is different.

Step S102: input the historical threat situation data to an evolution model that has been trained to convergence, to output each evolution mode corresponding to the historical threat situation data and a probability corresponding to the evolution mode.

In the embodiment, the evolution model that has been trained to convergence may use a BP neural network, i.e., an error back propagation neural network, so that if an error is found at the output end of the evolution model, it can be fed back to the input end, and the corresponding adjustment can be made to reduce the error of the evolution model.

In the embodiment, the flight threat itself has strong randomness and variability. The historical threat situation data will have multiple evolution modes and the probabilities corresponding to the evolution modes. To facilitate understanding, the embodiment will take common functions as an example, but it does not actually use the following functions for simple evolution. For example, when the type of the historical threat situation data is thunderstorm threat situation data, the evolution modes may have a linear function, a quadratic function and a cubic function. The three evolution modes correspond to the probabilities of 50%, 30% and 20% respectively. It shows that nearly half of the data evolves according to a linear function, 30% of the data evolves according to a quadratic function, and 20% of the data evolves according to a cubic function.

Step S103: obtain evolution trend data corresponding to the historical threat situation data according to the evolution mode and the probability.

In the embodiment, the evolution mode and the probability corresponding to the evolution mode may be merged to obtain the evolution trend data corresponding to the historical threat situation data, so as to predict a flight threat to the target aircraft during a preset future time period through the evolution trend data subsequently.

Step S104: assign a detection task to other aircraft within a preset range of a target aircraft according to a crowdsourcing strategy, and acquire current actual flight threat information detected by the other aircraft according to the detection task.

In the embodiment, the preset range of the target aircraft may be a sphere with the target aircraft as the origin and a radius of 5 kilometers. Within this range, there may be other aircraft. By acquiring the current actual flight threat information detected by the other aircraft, the actual situation within the preset range of the target aircraft may be obtained.

Step S105: determine enhanced evolution data according to the current actual flight threat information and the evolution trend data.

In the embodiment, through the crowdsourcing strategy, several aircrafts around the target aircraft are used to detect the actual flight threat information around them, and then the actual flight threat information detected by the surrounding aircrafts and the evolution trend data are used to determine the enhanced evolution data. The enhanced evolution data has higher accuracy in predicting the flight threat.

Step S106: acquire current flight route information of the target aircraft, and predict a flight threat to the target aircraft in a preset future time period according to the current flight route information and the enhanced evolution data.

In the embodiment, the current flight route information of the target aircraft is acquired, and the current flight route information may include current flight route position information and current flight route time information. The corresponding position in the enhanced evolution data can be matched according to the current flight route position information and the current flight route time information, so as to predict the flight threat to the target aircraft in the preset future time period.

Step S107: send pre-warning information to a pre-warning device if the flight threat meets a pre-warning condition.

In the embodiment, the pre-warning condition may be that the flight threat intensity is greater than a preset threshold, and at this time the pre-warning information may be sent to the pre-warning device. The pre-warning device may be installed inside the aircraft to achieve the effect of rapid pre-warning. The pre-warning device may send out an alarm by sounding, or by high-frequency flashes of red light.

In the embodiment, time may be used as a reference axis to extract the information of the part overlapped with the current flight route information at each time slot in the entire flight threat evolution pre-warning process, such as the distribution of the impact degree on a flight route section, and pack it as pre-warning information with a timestamp.

On this basis, basic attribute information (such as weight, model, etc.) of the aircraft and mission-status information (such as climbing, approaching, cruising, etc.) of the aircraft may be combined with control experience and expert knowledge, to customize matched pre-warning information for the aircraft, and the above pre-warning information may be sent to the cockpit through a data link, to be parsed by an onboard system and form a visual image to be fed back to the pilot.

The embodiment of present disclosure provides a method for pre-warning of aircraft flight threat evolution, which is applied to an electronic device and includes: acquiring historical threat situation data within a preset area range of a target flight route; inputting the historical threat situation data to an evolution model that has been trained to convergence, to output each evolution mode corresponding to the historical threat situation data and a probability corresponding to the evolution mode; obtaining evolution trend data corresponding to the historical threat situation data according to the evolution mode and the probability; acquiring current flight route information of the target aircraft, and predicting a flight threat to the target aircraft in a preset future time period according to the current flight route information and the enhanced evolution data; sending pre-warning information to a pre-warning device if the flight threat meets a pre-warning condition. In the method for pre-warning of aircraft flight threat evolution according to the embodiment of the present disclosure, the historical threat situation data within the preset area range of the target flight route is acquired and the historical threat situation data is inputted to the evolution model that has been trained to convergence, so as to obtain the evolution trend data corresponding to the historical threat situation data according to the outputted evolution mode and the probability; and the detection task is assigned to other aircraft within the preset range of the target aircraft according to the crowdsourcing strategy, so that the enhanced evolution data can be determined more accurately. Therefore, the flight threat in the preset future time period can be predicted according to the enhanced evolution data, and by considering the current flight route information of the target aircraft in combination with the enhanced evolution data, the flight threat to the target aircraft in the preset future time period can be predicted, so that when the flight threat meets the pre-warning condition, the pre-warning information is sent to the pre-warning device, thereby realizing the pre-warning of the aircraft flight threat.

Figure 3A:
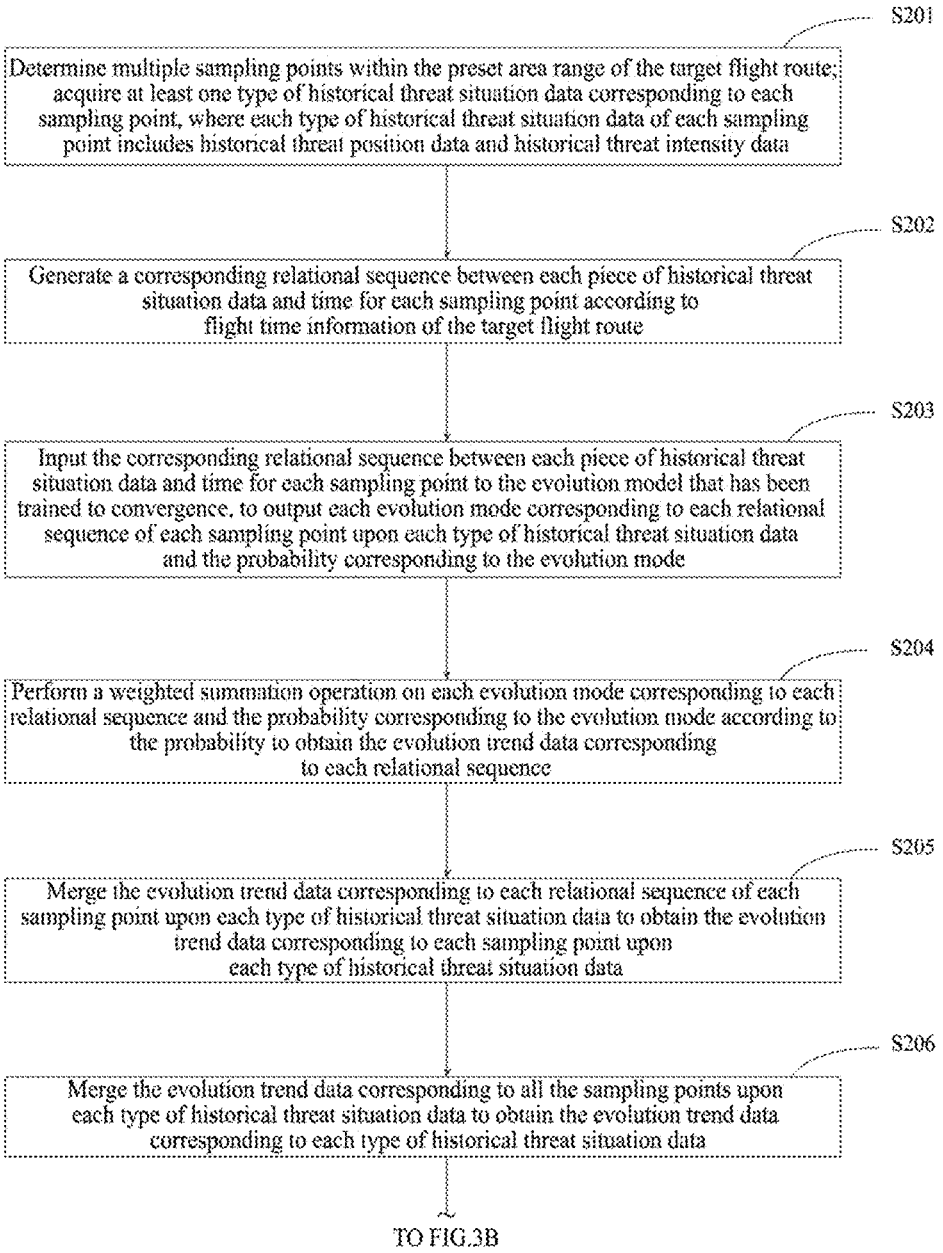
FIG. 3A and FIG. 3B is a schematic flowchart of a method for pre-warning of aircraft flight threat evolution provided by another embodiment of the present disclosure.
Figure 3B:
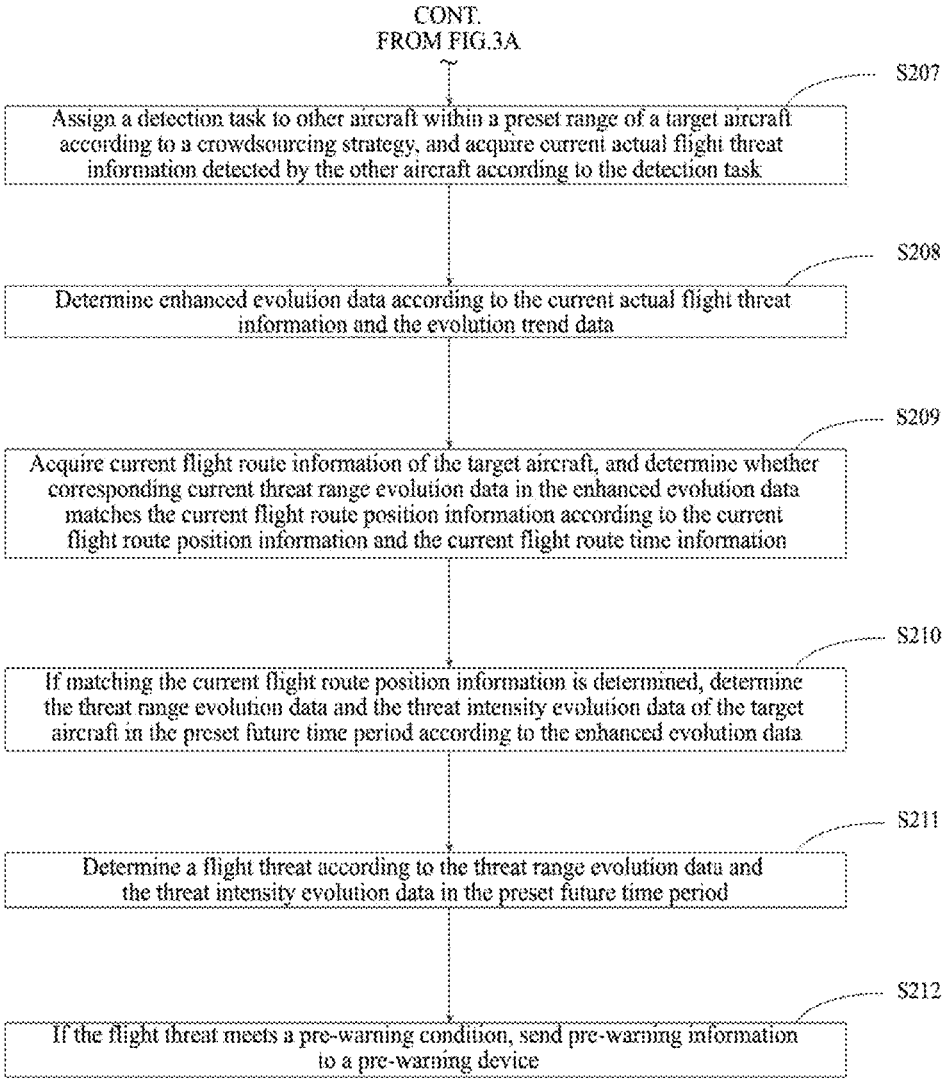

FIG. 3A and FIG. 3B is a schematic flowchart of a method for pre-warning of aircraft flight threat evolution provided by another embodiment of the present disclosure. As shown in FIG. 3A and FIG. 3B, the method for pre-warning of aircraft flight threat evolution provided in the embodiment is a further refinement of each step on the basis of the method for pre-warning of aircraft flight threat evolution provided in the previous embodiment of the present disclosure. The method for pre-warning of aircraft flight threat evolution provided in the embodiment includes the following steps.

Steps 201-202 are further refinements of step 101.

Step S201: determine multiple sampling points within a preset area range of a target flight route; acquire at least one type of historical threat situation data corresponding to each sampling point, where each type of historical threat situation data of each sampling point includes historical threat position data and historical threat intensity data.

In the embodiment, the number of sampling points may be multiple, and the larger the number of sampling points, the higher the accuracy of the subsequent prediction for the flight threat to the target aircraft according to the evolution trend data. The sampling points are located within the preset area range of the target flight route. The preset area range may be a sphere with the position in the target flight route as the origin and the preset value as the radius. Similarly, the preset area range may also be a cube, which is not limited in the embodiment. Similarly, the sampling points may also be sampling points acquired from a threat range corresponding to a certain type of historical threat situation data within the preset area range of the target flight route.

In the embodiment, a sampling point corresponds to at least one type of historical threat situation data, such as corresponding to thunderstorm threat situation data, turbulence threat situation data, and flight conflict threat situation data. The subsequent flight threat prediction may be more comprehensive by sampling and analyzing various types of historical threat situation data. And each type of historical threat situation data of each sampling point has both historical threat position data and historical threat intensity data, where the historical threat position data may be embodied by three-dimensional coordinate data of a historical threat.

Step S202: generate a corresponding relational sequence between each piece of historical threat situation data and time for each sampling point according to flight time information of the target flight route.

In the embodiment, the flight time information of the target flight route is information about all the time elapsed from the departure of the flight route to the arrival of the flight route. When the flight time information of the target flight route is used as the basis to generate the corresponding relational sequence between each piece of historical threat situation data and time for each sampling point, it may be more in line with the actual situation of the target flight route.

In the embodiment, the corresponding relational sequence between each piece of historical threat situation data and time for each sampling point includes relational sequences between three dimensions of X-axis, Y-axis, and Z-axis divided from the historical threat position data of each piece of historical threat situation data in the form of three-dimensional coordinate data with respect to time respectively, and a relational sequence of historical threat intensity data with respect to time. Thereby, four relational sequences are formed: the relational sequence between X and time, the relational sequence between Y and time, the relational sequence between Z and time, and the relational sequence between historical threat intensity data and time. The length of each relational sequence is related to the flight time information of the target flight route. Furthermore, the evolution over time of each piece of historical threat situation data corresponding to each sampling point can be obtained through the four relational sequences of each sampling point.

It should be noted that step 203 is a further refinement of step 102.

Step S203: input the corresponding relational sequence between each piece of historical threat situation data and time for each sampling point to the evolution model that has been trained to convergence, to output each evolution mode corresponding to each relational sequence of each sampling point upon each type of historical threat situation data and the probability corresponding to the evolution mode.

In the embodiment, the evolution model that has been trained to convergence is used to convert the corresponding relational sequence between each piece of historical threat situation data and time for each sampling point into each evolution mode corresponding to each relational sequence of each sampling point upon each type of historical threat situation data and the probability corresponding to the evolution mode. If each sampling point has 3 types of historical threat situation data, and each type of historical threat situation data has 4 relational sequences, then each sampling point will have 12 relational sequences. Each relational sequence has multiple evolution modes and the probabilities corresponding to the evolution modes.

In the embodiment, since each sampling point may correspond to different historical threat situation data, such as corresponding to thunderstorm threat situation data, turbulence threat situation data, and flight conflict threat situation data, the relational sequence corresponding to each sampling point may also correspond to different historical threat situation data, such as the relational sequence corresponding to thunderstorm, the relational sequence corresponding to turbulence, the relational sequence corresponding to flight conflict threats, etc. Each relational sequence may have multiple evolution modes and the probabilities corresponding to the evolution modes. To facilitate understanding, the embodiment will take common functions as an example, but it does not actually use the following functions for simple evolution. For example, when the type of the historical threat situation data is thunderstorm threat situation data, the evolution mode of the relational sequence corresponding to the thunderstorm threat situation data may have a linear function, a quadratic function, and a cubic function. The three evolution modes have the probabilities of 50%, 30% and 20%, respectively. It shows that nearly half of the data evolves according to a linear function, 30% of the data evolves according to a quadratic function, and 20% of the data evolves according to a cubic function. If there are other types of threat situation data, the principle is the same as above.

It should be noted that steps 204-206 are further refinements of step 103.

Step S204: perform a weighted summation operation on each evolution mode corresponding to each relational sequence and the probability corresponding to the evolution mode according to the probability to obtain the evolution trend data corresponding to each relational sequence.

In the embodiment, as illustrated by the above thunderstorm threat situation data, when performing a weighted summation operation on each evolution mode and the probability corresponding to each relational sequence in the thunderstorm threat situation data, the linear function is weighted by 0.5, and the quadratic function is weighted by 0.3, and the cubic function is weighted by 0.2, and after weighting, the three are summed to obtain the evolution trend data corresponding to each relational sequence.

In the embodiment, by performing a weighted summation operation on the corresponding evolution modes in each relational sequence and the probabilities corresponding to the evolution modes according to the probabilities, the obtained evolution trend data corresponding to each relational sequence may be more in line with actual threat changes, and the subsequent prediction of the flight threat to the target aircraft may be more accurate.

Step S205: merge the evolution trend data corresponding to each relational sequence of each sampling point upon each type of historical threat situation data to obtain the evolution trend data corresponding to each sampling point upon each type of historical threat situation data.

In the embodiment, since each sampling point has four relational sequences upon each type of historical threat situation data, the four relational sequences upon each type of historical threat situation data can be merged to obtain the corresponding evolution trend data upon each type of historical threat situation data.

Step S206: merge the evolution trend data corresponding to all the sampling points upon each type of historical threat situation data to obtain the evolution trend data corresponding to each type of historical threat situation data.

In the embodiment, since the sampling point has multiple types of the historical threat situation data, the evolution trend data corresponding to the sampling point upon each type of historical threat situation data may be merged to obtain the evolution trend data corresponding to each sampling point. The evolution trend data corresponding to all the sampling points can be merged to obtain the evolution trend data corresponding to each type of historical threat situation data.

Step S207: assign a detection task to other aircraft within a preset range of a target aircraft according to a crowdsourcing strategy, and acquire current actual flight threat information detected by the other aircraft according to the detection task.

In the embodiment, the implementation of step 207 is similar to the implementation of step 104 in the previous embodiment of the present disclosure, and will not be repeated here.

Step S208: determine enhanced evolution data according to the current actual flight threat information and the evolution trend data.

In the embodiment, the implementation of step 208 is similar to the implementation of step 105 in the previous embodiment of the present disclosure, and will not be repeated here.

It should be noted that steps 209-211 are further refinements of step 106 where the current flight route information includes current flight route position information and current flight route time information, and the enhanced evolution data includes threat range evolution data and threat intensity evolution data.

Step S209: acquire the current flight route information of the target aircraft, and determine whether corresponding current threat range evolution data in the enhanced evolution data matches the current flight route position information according to the current flight route position information and the current flight route time information.

In the embodiment, the method of acquiring the current flight route information of the target aircraft may be: acquiring through a control center or by other methods, which is not limited in the embodiment. Whether the corresponding current threat range evolution data in the enhanced evolution data matches the current flight route position information is determined according to the current flight route position information and the current flight route time information, so as to predict the flight threat to the target aircraft in a preset future time period in the case of matching.

Step S210: if matching the current flight route position information is determined, determine the threat range evolution data and the threat intensity evolution data of the target aircraft in the preset future time period according to the enhanced evolution data.

In the embodiment, the threat range evolution data may be determined by a change in the range formed by each sampling point. The threat intensity evolution data may be determined by evolution of threat intensity at each sampling point.

Step S211: determine a flight threat according to the threat range evolution data and the threat intensity evolution data in the preset future time period.

In the embodiment, the preset future time period may be within one hour, within two hours, or other times in the future, which may be set according to actual needs. The distance evolution between the target flight route of the target aircraft and the boundary of the flight threat range may be determined according to the threat range evolution data, so that the situation of flight threats to the target aircraft may be determined more accurately. The threat intensity evolution between the target flight route of the target aircraft and the boundary of the flight threat range may be determined according to the threat intensity evolution data. When a distance reaches a certain threshold and a threat intensity reaches a preset threshold, the pre-warning information is sent to the pre-warning device.

Step S212: if the flight threat meets a pre-warning condition, send pre-warning information to a pre-warning device.

In the embodiment, the implementation of step 212 is similar to the implementation of step 107 in the previous embodiment of the present disclosure, and will not be repeated here.

The embodiment of the present disclosure provides a method for pre-warning of aircraft flight threat evolution, where the historical threat situation data within the preset area range of the target flight route is acquired, and multiple sampling points within the preset area range of the target flight route are determined. There are multiple types of historical threat situation data corresponding to the sampling points, thereby the subsequent prediction can be made for the multiple types of historical threat situation data, so that the subsequent flight threat prediction can be more comprehensive. And the sampling points may be divided into four time-related relational sequences, so that the relational sequences may be input to the evolution model that has been trained to convergence, so as to obtain the subsequent evolution trend data corresponding to the historical threat situation data according to the outputted evolution modes and the probabilities corresponding to each relational sequence. And the detection task is assigned to other aircraft within the preset range of the target aircraft according to the crowdsourcing strategy, so that the enhanced evolution data can be determined more accurately. And by considering the current flight route information of the target aircraft in combination with the enhanced evolution data, the flight threat to the target aircraft in the preset future time period can be predicted, so that when the flight threat meets the pre-warning condition, the pre-warning information is sent to the pre-warning device, thereby realizing the pre-warning of the aircraft flight threat.

Figure 4:
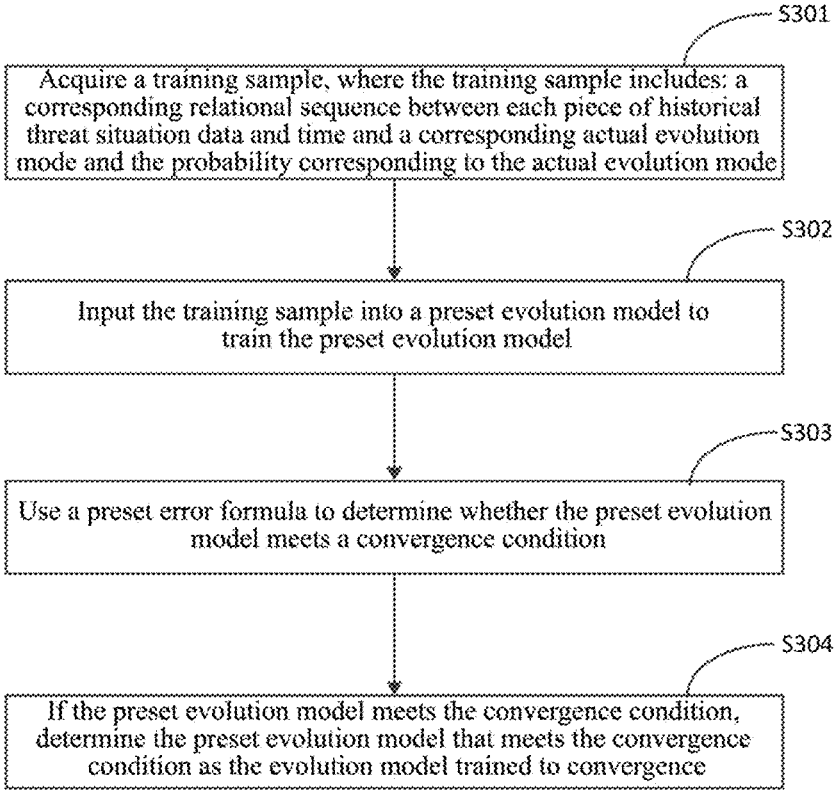
FIG. 4 is a schematic flowchart of evolution model training in a method for pre-warning of aircraft flight threat evolution provided by still another embodiment of the present disclosure.

FIG. 4 is a schematic flowchart of evolution model training in a method for pre-warning of aircraft flight threat evolution provided by another embodiment of the present disclosure. As shown in FIG. 4, the method for pre-warning of aircraft flight threat evolution provided in the embodiment is based on the method for pre-warning of aircraft flight threat evolution provided in the previous embodiment of the present disclosure, and the process of evolution model training and enhanced evolution are added. The method for pre-warning of aircraft flight threat evolution provided in the embodiment includes the following steps.

Step S301: acquire a training sample, where the training sample includes: a corresponding relational sequence between each piece of historical threat situation data and time and a corresponding actual evolution mode and a probability corresponding to the actual evolution mode.

In the embodiment, the training sample includes a relational sequence between each piece of historical threat situation data and time, and each actual evolution mode corresponding to the relational sequence and the probability corresponding to the actual evolution mode in each piece of collected historical threat situation data. Thus, the evolution model may be trained with actual historical threat situation data.

Step S302: input the training sample into a preset evolution model to train the preset evolution model.

In the embodiment, the preset evolution model is an evolution model that needs to be trained.

Step S303: use a preset error formula to determine whether the preset evolution model meets a convergence condition.

In the embodiment, after converging with the preset error formula, the evolution mode and the corresponding probability output by the preset evolution model are more accurate.

In the embodiment, the Xie and Beni index and the Fukuyama-Sugeno index are used in the evolution model to determine whether the current number of clusters is optimal.

Step S304: if the preset evolution model meets the convergence condition, determine the preset evolution model that meets the convergence condition as the evolution model that has been trained to convergence.

Optionally, in the embodiment, determining the enhanced evolution data according to the current actual flight threat information and the evolution trend data includes:

calculating an error value between the current actual flight threat information and the evolution trend data in a corresponding area;

inputting the error value into a preset prediction model to output a prediction error value;

determining the enhanced evolution data according to the evolution trend data and the prediction error value.

In the embodiment, the flight threat trajectory and weather threat information of other aircraft may be compared with the data of the position corresponding to the evolution trend data, so as to calculate the error between the two to obtain a prediction error sequence during a period of time. Then, the prediction error sequence is predicted according to the Holt quadratic exponential smoothing time series prediction model, and the error change in the preset future time period can be obtained. Therefore, the enhanced evolution data can be determined according to the error change and the evolution trend data.

The principle of prediction is:

$$S_t=\alpha\Delta_{nit}+(1-\alpha)(S_{t-1}+b_{t-1})$$

$$b_t=\beta(S_t-S_{t-1})+(1-\beta)b_{t-1}$$

where, $\Delta_{nit}$ is x may be obtained by predicting historical error data and using the least square method.

The embodiment of the present disclosure provides a method for pre-warning of aircraft flight threat evolution, where historical threat situation data within a preset area range of a target flight route is acquired, and multiple sampling points within the preset area range of the target flight route are determined. There are multiple types of historical threat situation data corresponding to the sampling points, and the sampling points may be divided into four time-related relational sequences, so that the relational sequences are inputted to the evolution model that has been trained to convergence so as to obtain the evolution trend data corresponding to the historical threat situation data according to the outputted evolution mode and the probability corresponding to each relational sequence subsequently. The detection task is assigned to other aircraft within the preset range of the target aircraft according to a crowdsourcing strategy to obtain the current actual flight threat information detected by other aircraft according to the detection task. The enhanced evolution data is determined according to the current actual flight threat information and the evolution trend data. The current flight route information of the target aircraft is obtained, and the flight threat to the target aircraft in the preset future time period is predicted according to the current flight route information and the enhanced evolution data, thereby improving the accuracy of prediction. Therefore, when the flight threat meets the pre-warning condition, the pre-warning information is sent to the pre-warning device, thereby realizing the pre-warning of the aircraft flight threat.

Figure 5:
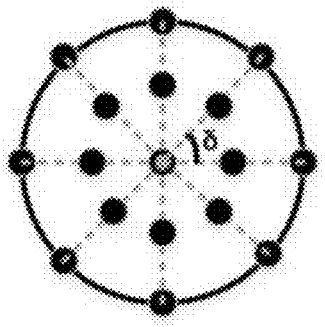
FIG. 5 is a schematic diagram of sampling point selection of a method for pre-warning of aircraft flight threat evolution provided by an embodiment of the present disclosure.

FIG. 5 is a schematic diagram of sampling point selection of a method for pre-warning of aircraft flight threat evolution provided by an embodiment of the present disclosure. As shown in FIG. 5, the method for pre-warning of aircraft flight threat evolution provided in the embodiment is based on the method for pre-warning of aircraft flight threat evolution provided in the above embodiment of the present disclosure, describing the method of sampling point selection and the process of evolution model construction in conjunction with FIG. 5. The method for pre-warning of aircraft flight threat evolution provided in the embodiment includes the following steps.

From a spatial point of view, a rule for sampling point selection is: taking the geometric center of an impact range as the origin, sampling at the boundary every δ degrees to obtain the position and intensity data of the boundary points. And on the line connecting a boundary point and the origin, n−1 points are selected with a division value of 1/n as the sampling points reflecting the change in impact intensity. Taking the situation formed by a circular impact range and equivalent impact intensity as an example, let 6=45, n=2, and its two-dimensional spatial sampling at a fixed time point is as shown in FIG. 5.

On this basis, the relational sequence with respect to time of each sampling point is decomposed into four one-dimensional relational sequences with respect to time according to the three-dimensional position XYZ and intensity. For a specific situation, 360/δ×(n−1)×4 one-dimensional time sequences may be generated, that is, the number of the relational sequences is 4 times the number of sampling points.

The construction process of the evolution model is as follows.

Evolution modes of the relational sequences are extracted in the evolution model based on FCM. Each group of relational sequences is clustered based on the FCM algorithm. The advantage of the algorithm is that there is uncertainty in the evolution of the situation and there is no clear derivation process, and therefore, applying fuzzy idea can reduce the influence of uncertainty on the result and improve the robustness of the evolution result.

A BP neural network is used as a model skeleton. And several relational sequences of the historical threat situation data are used as input, and the probabilities of the evolution modes of the relational sequences obtained by the FCM algorithm are used as labels, which are used as the output of the BP neural network.

A training set is acquired and a structure of the BP neural network is combined, a sigmoid function is used as the neuron activation function, and the back propagation algorithm is employed to train the neural network to build the evolution model.

Figure 6:
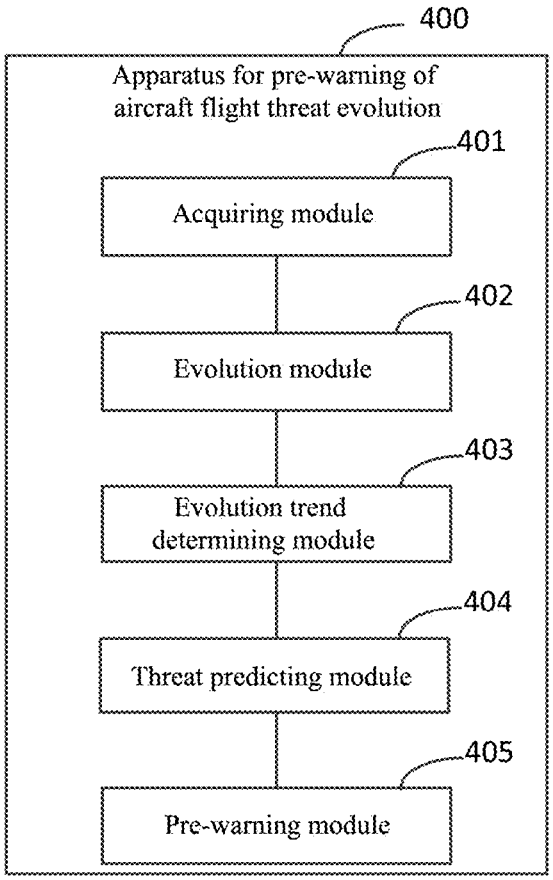
FIG. 6 is a schematic structural diagram of an apparatus for pre-warning of aircraft flight threat evolution provided by an embodiment of the present disclosure.

FIG. 6 is a schematic structural diagram of an apparatus for pre-warning of aircraft flight threat evolution provided by an embodiment of the present disclosure. As shown in FIG. 6, in the embodiment, the apparatus is located in an electronic device, and the apparatus for pre-warning of aircraft flight threat evolution 400 includes:

an acquiring module 401, configured to acquire historical threat situation data within a preset area range of a target flight route;

an evolution module 402, configured to input the historical threat situation data to an evolution model that has been trained to convergence, to output each evolution mode corresponding to the historical threat situation data and a probability corresponding to the evolution mode;

an evolution trend determining module 403, configured to obtain evolution trend data corresponding to the historical threat situation data according to the evolution mode and the probability;

a threat predicting module 404, configured to assign a detection task to other aircraft within a preset range of a target aircraft according to a crowdsourcing strategy, and acquire current actual flight threat information detected by the other aircraft according to the detection task; determine enhanced evolution data according to the current actual flight threat information and the evolution trend data; acquire current flight route information of the target aircraft, and predict a flight threat to the target aircraft in a preset future time period according to the current flight route information and the enhanced evolution data;

a pre-warning module 405, configured to send pre-warning information to a pre-warning device if the flight threat meets a pre-warning condition.

The apparatus for pre-warning of aircraft flight threat evolution provided in the embodiment can implement the technical solution of the method embodiment shown in FIG. 2, and its implementation principles and technical effects are similar to those of the method embodiment shown in FIG. 2, and will not be repeated here.

And another embodiment of the apparatus for pre-warning of aircraft flight threat evolution provided by the present disclosure further refines the apparatus for pre-warning of aircraft flight threat evolution 400 on the basis of the apparatus for pre-warning of aircraft flight threat evolution provided in the previous embodiment.

Optionally, in the embodiment, the acquiring module 401 is specifically configured to:

determine multiple sampling points within the preset area range of the target flight route; acquire at least one type of historical threat situation data corresponding to each sampling point, where each type of historical threat situation data of each sampling point includes historical threat position data and historical threat intensity data; and generate a corresponding relational sequence between each piece of historical threat situation data and time for each sampling point according to flight time information of the target flight route;

And, the evolution module 402 is specifically configured to:

input the corresponding relational sequence between each piece of historical threat situation data and time for each sampling point to the evolution model that has been trained to convergence, to output each evolution mode corresponding to each relational sequence of each sampling point upon each type of historical threat situation data and the probability corresponding to the evolution mode.

Optionally, in the embodiment, the evolution trend determining module 403 is specifically configured to:

perform a weighted summation operation on each evolution mode corresponding to each relational sequence and the probability corresponding to the evolution mode according to the probability to obtain the evolution trend data corresponding to each relational sequence; merge the evolution trend data corresponding to each relational sequence of each sampling point upon each type of historical threat situation data to obtain the evolution trend data corresponding to each sampling point upon each type of historical threat situation data; and finally, merge the evolution trend data corresponding to all the sampling points upon each type of historical threat situation data to obtain the evolution trend data corresponding to each type of historical threat situation data.

Optionally, in the embodiment, the current flight route information includes current flight route position information and current flight route time information; and the enhanced evolution data includes threat range evolution data and threat intensity evolution data.

When predicting the flight threat to the target aircraft in the preset future time period according to the current flight route information and the enhanced evolution data, the threat predicting module 404 is specifically configured to:

determine whether corresponding current threat range evolution data in the enhanced evolution data matches the current flight route position information according to the current flight route position information and the current flight route time information; if matching the current flight route position information is determined, determine the threat range evolution data and the threat intensity evolution data of the target aircraft in the preset future time period according to the enhanced evolution data; and determine the flight threat according to the threat range evolution data and the threat intensity evolution data in the preset future time period.

Optionally, in the embodiment, the apparatus for pre-warning of aircraft flight threat evolution further includes a training module, and the training module is configured to:

acquire a training sample, where the training sample includes: the corresponding relational sequence between each piece of historical threat situation data and time and a corresponding actual evolution mode and a probability corresponding to the actual evolution mode; input the training sample into a preset evolution model to train the preset evolution model; use a preset error formula to determine whether the preset evolution model meets a convergence condition; if the preset evolution model meets the convergence condition, determine the preset evolution model that meets the convergence condition as the evolution model that has been trained to convergence.

Optionally, in the embodiment, when determining the enhanced evolution data according to the current actual flight threat information and the evolution trend data, the threat predicting module 404 is specifically configured to:

calculate an error value between the current actual flight threat information and the evolution trend data in a corresponding area; input the error value into a preset prediction model to output a prediction error value; determine the enhanced evolution data according to the evolution trend data and the prediction error value.

The apparatus for pre-warning of aircraft flight threat evolution provided in the embodiment can implement the technical solution of the method embodiment shown in FIG. 2-FIG. 4, and its implementation principles and technical effects are similar to those of the method embodiment shown in FIG. 2-FIG. 4, and will not be repeated here.

According to an embodiment of the present disclosure, an electronic device and a computer readable storage medium are further provided.

Figure 7:
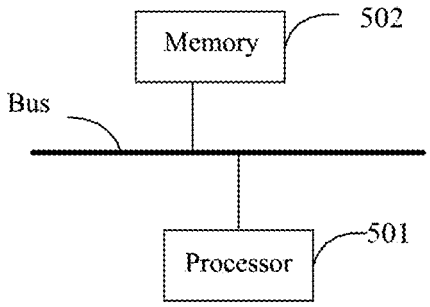
FIG. 7 is a schematic structural diagram of an electronic device provided by an embodiment of the present disclosure.

As shown in FIG. 7, FIG. 7 is a schematic structural diagram of an electronic device provided by an embodiment of the present disclosure. The electronic device is intended to represent various forms of digital computers, such as a laptop computer, a desktop computer, a workstation, a personal digital assistant, a server, a blade server, a mainframe computer, and other suitable computers. The electronic device may also represent various forms of mobile apparatuses, such as a personal digital assistant, a cellular phone, a smart phone, a wearable device, and other similar computing apparatuses. Components shown herein, connections and relationships thereof, as well as functions thereof are merely examples and are not intended to limit implementations of the present disclosure described and/or claimed herein.

As shown in FIG. 7, the electronic device includes: a processor 501 and a memory 502. Various components are interconnected through different buses and may be installed on a common motherboard or be installed in other ways as required. The processor may process instructions executed in the electronic device.

The memory 502 is a non-transitory computer-readable storage medium provided by the present disclosure, where the memory stores instructions executable by at least one processor to cause the at least one processor to perform the method for pre-warning of aircraft flight threat evolution provided by the present disclosure. The non-transitory computer-readable storage medium of the present disclosure stores computer instructions, and the computer instructions are used to cause a computer to perform the method for pre-warning of aircraft flight threat evolution provided by the present disclosure.

The memory 502, as a non-transitory computer-readable storage medium, may be used to store a non-transitory software program, a non-transitory computer-executable program and modules, such as program instructions/modules (e.g., the acquiring module 401, the evolution module 402, the evolution trend determining module 403, the threat predicting module 404 and the pre-warning module 405 in FIG. 6) corresponding to the method for pre-warning of aircraft flight threat evolution in the embodiments of the present disclosure. By running the non-transitory software program, instructions and modules stored in the memory 502, the processor 501 performs various functional applications and data processing of a sever, that is, realizes the method for pre-warning of aircraft flight threat evolution in the above method embodiments.

After considering the specification and practicing the disclosure disclosed herein, the skilled in the art will easily think of other implementations of the embodiments of the present disclosure. The present disclosure is intended to cover any variations, uses, or adaptive changes of the embodiments of the present disclosure. These variations, uses, or adaptive changes follow the general principles of the embodiments of the present disclosure and include common knowledge or conventional technical means in the technical field that are not disclosed by the embodiments of the present disclosure. The specification and the embodiments are only regarded as illustrative, and the true scope and spirit of the embodiments of the present disclosure are indicated by the following claims.

It should be understood that the embodiments of the present disclosure are not limited to the precise structure that has been described above and shown in the drawings, and various modifications and changes may be made without departing from the scope thereof. The scope of the embodiments of the present disclosure is only limited by the appended claims.

What is claimed is:

1. A method for pre-warning of aircraft flight threat evolution, which is applied to an electronic device and comprises:

acquiring historical threat situation data within a preset area range of a target flight route;

inputting the historical threat situation data to an evolution model that has been trained to convergence, to output at least one evolution mode corresponding to the historical threat situation data and a probability corresponding to each evolution mode;

obtaining evolution trend data corresponding to the historical threat situation data according to evolution modes and the corresponding probability;

assigning a detection task to other aircraft within a preset range of a target aircraft according to a crowdsourcing strategy, and acquiring current actual flight threat information detected by the other aircraft according to the detection task;

determining enhanced evolution data according to the current actual flight threat information and the evolution trend data;

acquiring current flight route information of the target aircraft, and predicting a flight threat to the target aircraft in a preset future time period according to the current flight route information and the enhanced evolution data; and sending pre-warning information to a pre-warning device if the flight threat meets a pre-warning condition.

2. The method according to claim 1, wherein the acquiring the historical threat situation data within the preset area range of the target flight route comprises:

determining multiple sampling points within the preset area range of the target flight route;

acquiring at least one type of historical threat situation data corresponding to each sampling point, wherein each type of historical threat situation data of each sampling point includes historical threat position data and historical threat intensity data;

generating a corresponding relational sequence between each piece of historical threat situation data and time for each sampling point according to flight time information of the target flight route;

the inputting the historical threat situation data into the evolution model that has been trained to convergence, to output at least one evolution mode corresponding to the historical threat situation data and the probability corresponding to each evolution mode comprises:

inputting the corresponding relational sequence between each piece of historical threat situation data and time for each sampling point to the evolution model that has been trained to convergence, to output each evolution mode corresponding to each relational sequence of each sampling point upon each type of historical threat situation data and the probability corresponding to each evolution mode.

3. The method according to claim 2, wherein the obtaining the evolution trend data corresponding to the historical threat situation data according to evolution modes and the corresponding probability comprises:

performing a weighted summation operation on each evolution mode corresponding to each relational sequence and the probability corresponding to each evolution mode according to the probability to obtain the evolution trend data corresponding to each relational sequence;

merging the evolution trend data corresponding to each relational sequence of each sampling point upon each type of historical threat situation data to obtain the evolution trend data corresponding to each sampling point upon each type of historical threat situation data; and merging the evolution trend data corresponding to all the sampling points upon each type of historical threat situation data to obtain the evolution trend data corresponding to each type of historical threat situation data.

4. The method according to claim 2, wherein before the inputting the historical threat situation data to the evolution model that has been trained to convergence, the method further comprises:

acquiring a training sample, wherein the training sample includes: the corresponding relational sequence between each piece of historical threat situation data and time and a corresponding actual evolution mode and a probability corresponding to the actual evolution mode;

inputting the training sample into a preset evolution model to train the preset evolution model;

using a preset error formula to determine whether the preset evolution model meets a convergence condition; and if the preset evolution model meets the convergence condition, determining the preset evolution model that meets the convergence condition as the evolution model that has been trained to convergence.

5. The method according to claim 1, wherein the current flight route information includes current flight route position information and current flight route time information; the enhanced evolution data includes threat range evolution data and threat intensity evolution data;

the predicting the flight threat to the target aircraft in the preset future time period according to the current flight route information and the enhanced evolution data comprises:

determining whether corresponding current threat range evolution data in the enhanced evolution data matches the current flight route position information according to the current flight route position information and the current flight route time information;

if matching the current flight route position information is determined, determining the threat range evolution data and the threat intensity evolution data of the target aircraft in the preset future time period according to the enhanced evolution data; and determining the flight threat according to the threat range evolution data and the threat intensity evolution data in the preset future time period.

6. The method according to according to claim 1, wherein the determining the enhanced evolution data according to the current actual flight threat information and the evolution trend data comprises:

calculating an error value between the current actual flight threat information and the evolution trend data in a corresponding area;

inputting the error value into a preset prediction model to output a prediction error value; and determining the enhanced evolution data according to the evolution trend data and the prediction error value.

7. A device for pre-warning of aircraft flight threat evolution, comprising: a memory, a processor;

wherein the memory is configured to store instructions executable by the processor; and the processor, when executing the instructions, is configured to:

acquire historical threat situation data within a preset area range of a target flight route;

input the historical threat situation data to an evolution model that has been trained to convergence, to output at least one evolution mode corresponding to the historical threat situation data and a probability corresponding to each evolution mode;

obtain evolution trend data corresponding to the historical threat situation data according to evolution modes and the corresponding probability;

assign a detection task to other aircraft within a preset range of a target aircraft according to a crowdsourcing strategy, and acquire current actual flight threat information detected by the other aircraft according to the detection task; determine enhanced evolution data according to the current actual flight threat information and the evolution trend data; acquire current flight route information of the target aircraft, and predict a flight threat to the target aircraft in a preset future time period according to the current flight route information and the enhanced evolution data; and send pre-warning information to a pre-warning device if the flight threat meets a pre-warning condition.

8. The device according to according to claim 7, wherein the processor is further configured to:

determine multiple sampling points within the preset area range of the target flight route; acquire at least one type of historical threat situation data corresponding to each sampling point, wherein each type of historical threat situation data of each sampling point includes historical threat position data and historical threat intensity data; generate a corresponding relational sequence between each piece of historical threat situation data and time for each sampling point according to flight time information of the target flight route; and input the corresponding relational sequence between each piece of historical threat situation data and time for each sampling point to the evolution model that has been trained to convergence, to output each evolution mode corresponding to each relational sequence of each sampling point upon each type of historical threat situation data and the probability corresponding to each evolution mode.

9. The device according to according to claim 8, wherein the processor is further configured to:

perform a weighted summation operation on each evolution mode corresponding to each relational sequence and the probability corresponding to each evolution mode according to the probability to obtain the evolution trend data corresponding to each relational sequence;

merge the evolution trend data corresponding to each relational sequence of each sampling point upon each type of historical threat situation data to obtain the evolution trend data corresponding to each sampling point upon each type of historical threat situation data; and merge the evolution trend data corresponding to all the sampling points upon each type of historical threat situation data to obtain the evolution trend data corresponding to each type of historical threat situation data.

10. The device according to according to claim 7, wherein the current flight route information includes current flight route position information and current flight route time information; the enhanced evolution data includes threat range evolution data and threat intensity evolution data;

the processor is further configured to:

determine whether corresponding current threat range evolution data in the enhanced evolution data matches the current flight route position information according to the current flight route position information and the current flight route time information;

if matching the current flight route position information is determined, determine the threat range evolution data and the threat intensity evolution data of the target aircraft in the preset future time period according to the enhanced evolution data; and determine the flight threat according to the threat range evolution data and the threat intensity evolution data in the preset future time period.

11. The device according to according to claim 7, wherein the processor is further configured to:

acquire a training sample, wherein the training sample includes: the corresponding relational sequence between each piece of historical threat situation data and time and a corresponding actual evolution mode and a probability corresponding to the actual evolution mode;

input the training sample into a preset evolution model to train the preset evolution model;

use a preset error formula to determine whether the preset evolution model meets a convergence condition; and if the preset evolution model meets the convergence condition, determine the preset evolution model that meets the convergence condition as the evolution model that has been trained to convergence.

12. The device according to according to claim 7, wherein the processor is further configured to:

calculate an error value between the current actual flight threat information and the evolution trend data in a corresponding area;

input the error value into a preset prediction model to output a prediction error value; and determine the enhanced evolution data according to the evolution trend data and the prediction error value.

13. A non-transitory computer-readable storage medium having computer-executable instructions stored thereon which, when executed by a processor, used to implement the method for pre-warning of aircraft flight threat evolution according to claim 1.

* * * * *